US006026654A

United States Patent [19]

Park

[11] Patent Number: 6,026,654

[45] Date of Patent: Feb. 22, 2000

[54] MULTI-UNIT AIR CONDITIONER HAVING A BY-PASS SECTION FOR ADJUSTING A FLOW RATE OF REFRIGERANT

[75] Inventor: Hyug-Bum Park, Kyungki-Do, Rep. of Korea

[73] Assignee: Samsung Electronics Co., Ltd., Suwon, Rep. of Korea

[21] Appl. No.: 09/148,495

[22] Filed: Sep. 4, 1998

[30] Foreign Application Priority Data

Apr. 6, 1998 [KR] Rep. of Korea ..... 98-12050

[51] Int. Cl.[7] ..... F25B 5/00

[52] U.S. Cl. ..... 62/199; 62/196.1; 62/228.5

[58] Field of Search ..... 62/196.1, 196.3, 62/196.2, 199, 200, 228.5, 197

[56] References Cited

U.S. PATENT DOCUMENTS

| | | | |
|---|---|---|---|
| 2,461,760 | 2/1949 | Newton | 62/4 |
| 2,936,595 | 5/1960 | Dillman et al. | 62/197 |
| 3,390,540 | 7/1968 | Brush | 62/200 |
| 3,464,226 | 9/1969 | Kramer | 62/196 |
| 3,779,031 | 12/1973 | Akiyama et al. | 62/160 |
| 4,513,581 | 4/1985 | Mizobuchi et al. | 62/197 |
| 4,658,596 | 4/1987 | Kuwahara | 62/197 |

*Primary Examiner*—Henry Bennett
*Assistant Examiner*—Marc Norman
*Attorney, Agent, or Firm*—Burns, Doane, Swecker & Mathis, L.L.P.

[57] ABSTRACT

A multi-unit air conditioner has a compressor for compressing refrigerant, an outdoor heat-exchanger for receiving compressed refrigerant from the compressor, and a plurality of indoor heat-exchangers connected in parallel with the outdoor heat-exchanger for receiving heat-exchanged refrigerant therefrom. A by-pass section is provided for returning some of the refrigerant from the outdoor heat-exchanger back to the compressor inlet when one of the indoor heat-exchangers is inactive, to restrict the amount of refrigerant supplied to the active indoor heat exchanger.

12 Claims, 2 Drawing Sheets

MULTI-UNIT AIR CONDITIONER HAVING A BY-PASS SECTION FOR ADJUSTING A FLOW RATE OF REFRIGERANT

BACKGROUND OF THE INVENTION

1. Field of the Invention

The present invention relates to a multi-unit air conditioner connected with a compressor and at least two indoor heat-exchangers.

2. Description of the Prior Art

Generally, an air conditioner comprises a compressor, an indoor heat-exchanger, a capillary tube, and an outdoor heat-exchanger, for adjusting indoor air conditions to an optimum state by means of refrigerant circulating therethrough.

Recently, a multi-unit air conditioner is available. The multi-unit air conditioner is so-called because it includes a plurality of indoor heat-exchangers respectively connected to each other in parallel and those heat-exchangers are connected to a high-capacity compressor in series. Indoor heat-exchangers of the multi-unit air conditioner are installed at respective room areas.

An example of such a multi-unit air conditioner is shown in FIG. 1.

As shown in the figure, the multi-unit air conditioner includes two compressors and 12, one outdoor heat-exchanger 20, and three indoor heat-exchangers 51, 52*a*, and 52*b*.

The outdoor heat-exchanger 20 includes a circulation path 21 through which the refrigerant compressed in the compressor 11 is circulated, and two circulation paths 22*a*, 22*b* through which respective portions of the refrigerant compressed in the compressor 12 are circulated. Outlets of the two paths 22*a*, 22*b* converge at 22*c*.

An outlet of the circulation path 21 is connected with the single-unit indoor heat-exchanger 51 through a refrigerant pipe 1. A capillary tube 31 for reducing the pressure of the refrigerant passing therethrough is installed in the refrigerant pipe 1 between the circulation path 21 and the single-unit indoor heat-exchanger 51.

Another refrigerant pipe 2 connected with the multi-unit circulation path 22 is divided into two branches respectively connected with multi-unit indoor heat-exchangers 52*a* and 52*b*.

A capillary tube 33 is installed in the refrigerant pipe 2 upstream of the point where the latter is divided into two branches 2*a*, 2*b*, for reducing the pressure of the refrigerant. A flow controlling pipe 3 provided with a flow controlling valve 43 is connected with the capillary tube 33 in parallel. When the valve 43 is open, refrigerant flows therethrough and by-passes the capillary tube 33.

The branches 2*a* and 2*b* are provided with capillary tubes 32*a* and 32*b*, respectively, and a pair of opening/closing valves 42*a* and 42*b* are connected to respective ones of the capillary tubes 32*a* and 32*b* in series.

An outlet of the single-unit indoor heat-exchanger 51 is connected with an inlet of the single-unit compressor 11, and the outlets of both of the multi-unit indoor heat-exchangers 52*a* and 52*b* are connected with an inlet of the multi-unit compressor 12.

In the multi-unit air conditioner constructed as above, a first supply of refrigerant is circulated through a single-unit refrigerant circulating cycle, i.e., the refrigerant compressed in the single-unit compressor 11 is circulated subsequently through the single-unit circulation path 21 of the outdoor heat-exchanger 20, the capillary tube 31, the single-unit indoor heat-exchanger 51, and back to the single-unit compressor 11.

A second supply of refrigerant compressed in the multi-unit compressor 12 is circulated through a multi-unit refrigerant circulating cycle, i.e., the refrigerant compressed in the multi-unit compressor 12 is subsequently circulated through the multi-unit circulation path 22 of the outdoor heat-exchanger 20, capillary tubes 32 and 33, multi-unit indoor heat-exchangers 52*a* and 52*b*, and back to the multi-unit compressor 12.

Operations of the single-unit and multi-unit refrigerant circulating cycles are respectively controlled.

More specifically, when both of the multi-unit indoor heat-exchangers 52*a* and 52*b* are simultaneously in use, the flow controlling valve 43 is in a closed state, while both of the opening/closing valves 42*a* and 42*b* are in an open state.

The flow controlling valve 43 is opened and one 42*a* of the opening/closing valves 42*a* and 42*b* is closed, when only one (e.g., 52*b*) of the multi-unit indoor heat-exchangers 52*a* and 52*b* is in use. At this instance, the refrigerant flows through the flow controlling valve 43 so that it does not flow through the capillary tube 33. Thereby, a moderate amount of refrigerant for efficient compressing can be converged back into the multi-unit compressor 12 solely from indoor heat-exchanger 52*b*.

However, the conventional multi-unit air conditioner has drawbacks as explained below.

When only one (e.g., 52*b*) of the indoor heat-exchangers 52*a* and 52*b* is operated, the moderate amount of the refrigerant for compressing is returned to the multi-unit compressor 12 since the flow controlling valve 43 is opened. At the same time, however, the opening of the valve 43 causes the amount of refrigerant supplied into the one indoor heat-exchanger 52*b* in use to be increased. Accordingly, some of that refrigerant supplied into the indoor heat-exchanger 52*b* is incompletely evaporated, and supplied into the compressor 12 in a liquid state which causes a malfunction of the compressor 12. In addition, an excessive amount of refrigerant supplied into the indoor heat-exchanger 52*b* can cause a freezing of the evaporator while it is being evaporated therein.

SUMMARY OF THE INVENTION

Accordingly, an object of the present invention is to provide a multi-unit air conditioner for adjusting the flow rate of the refrigerant of an indoor heat-exchanger at a reasonable degree regardless of how many of the indoor heat-exchangers of the multi-unit air conditioner are in use.

That object is accomplished by a multi-unit air conditioner comprises a compressor for compressing a refrigerant, an outdoor heat-exchanger for lowering a temperature of the refrigerant compressed by the compressor, a pair of indoor heat-exchangers connected with each other in parallel between the outdoor heat-exchanger and the compressor, a pair of pressure reducing devices respectively installed at refrigerant pipes connecting the outdoor heat-exchanger with a pair of indoor heat-exchangers, a pair of opening/closing valves respectively installed at the refrigerant pipes and a by-pass section for returning a portion of the refrigerant back to the compressor inlet before that portion of the refrigerant reaches the indoor heat-exchanger when one of the opening/closing valves is closed.

More specifically, the by-pass section includes a by-pass pipe connecting the inlet of the outdoor heat-exchanger with the compressor inlet, and a by-pass valve installed at the by-pass pipe to be opened when one of the opening/closing valves is closed. Preferably, the pressure-reducing device is a capillary tube installed at the by-pass pipe for reducing a pressure of the refrigerant by-passed through the by-pass pipe.

Therefore, when one of the indoor heat-exchangers is not operated, due to its opening/closing valve being closed, the by-pass valve is opened. Accordingly, some of the refrigerant compressed by the compressor is returned to the compressor inlet, so that the flow rate of the refrigerant introduced into an active indoor heat-exchanger can be maintained to a reasonable degree.

BRIEF DESCRIPTION OF THE DRAWINGS

The above object and advantages will be more apparent from a preferred embodiment thereof described in detail with reference to the accompanying drawings, in which.

DETAILED DESCRIPTION OF THE PREFERRED EMBODIMENT

Figure 1:
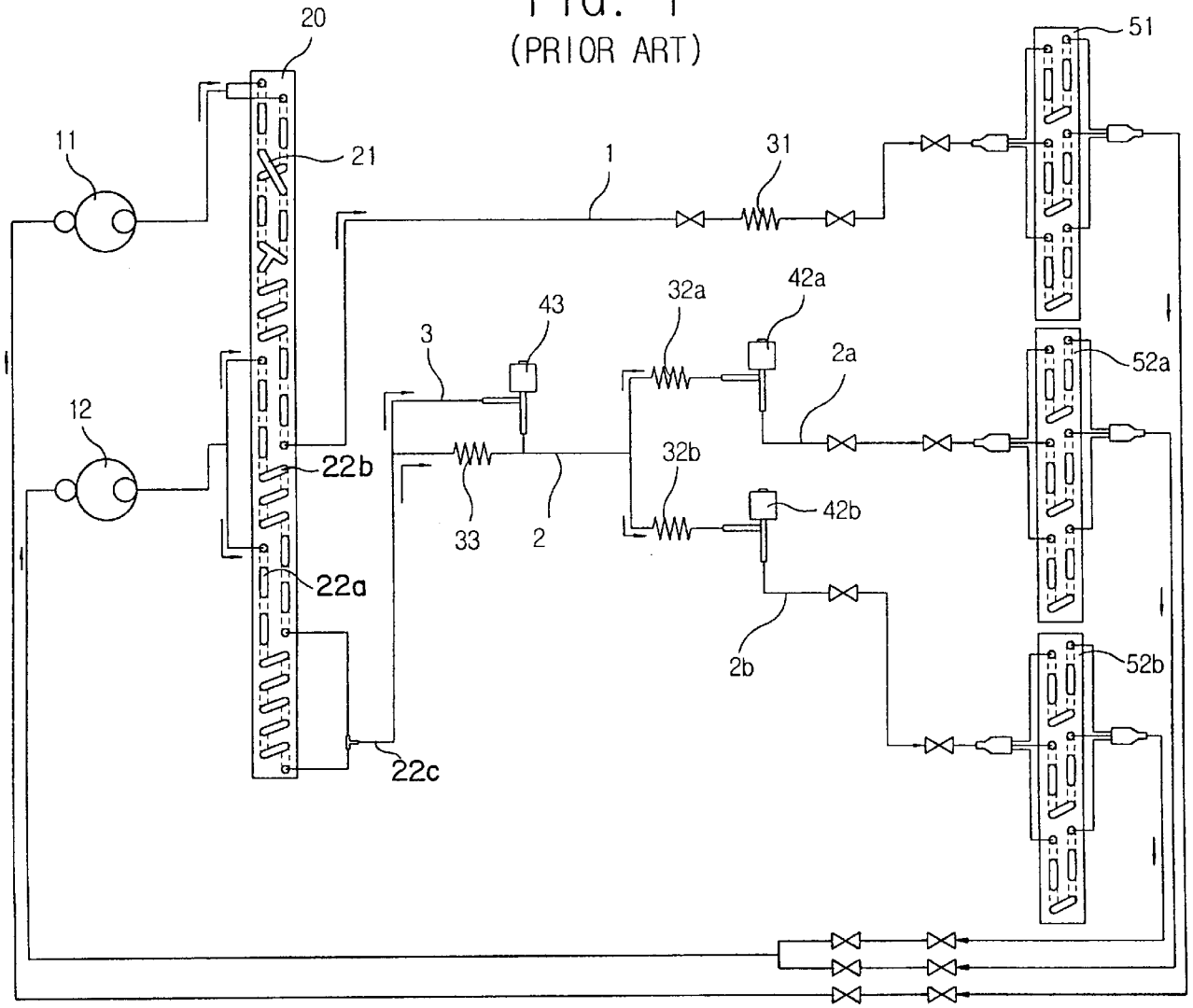
FIG. 1 (PRIOR ART)
FIG. 1 is a schematic view showing an example of a conventional multi-unit air conditioner.
Figure 2:
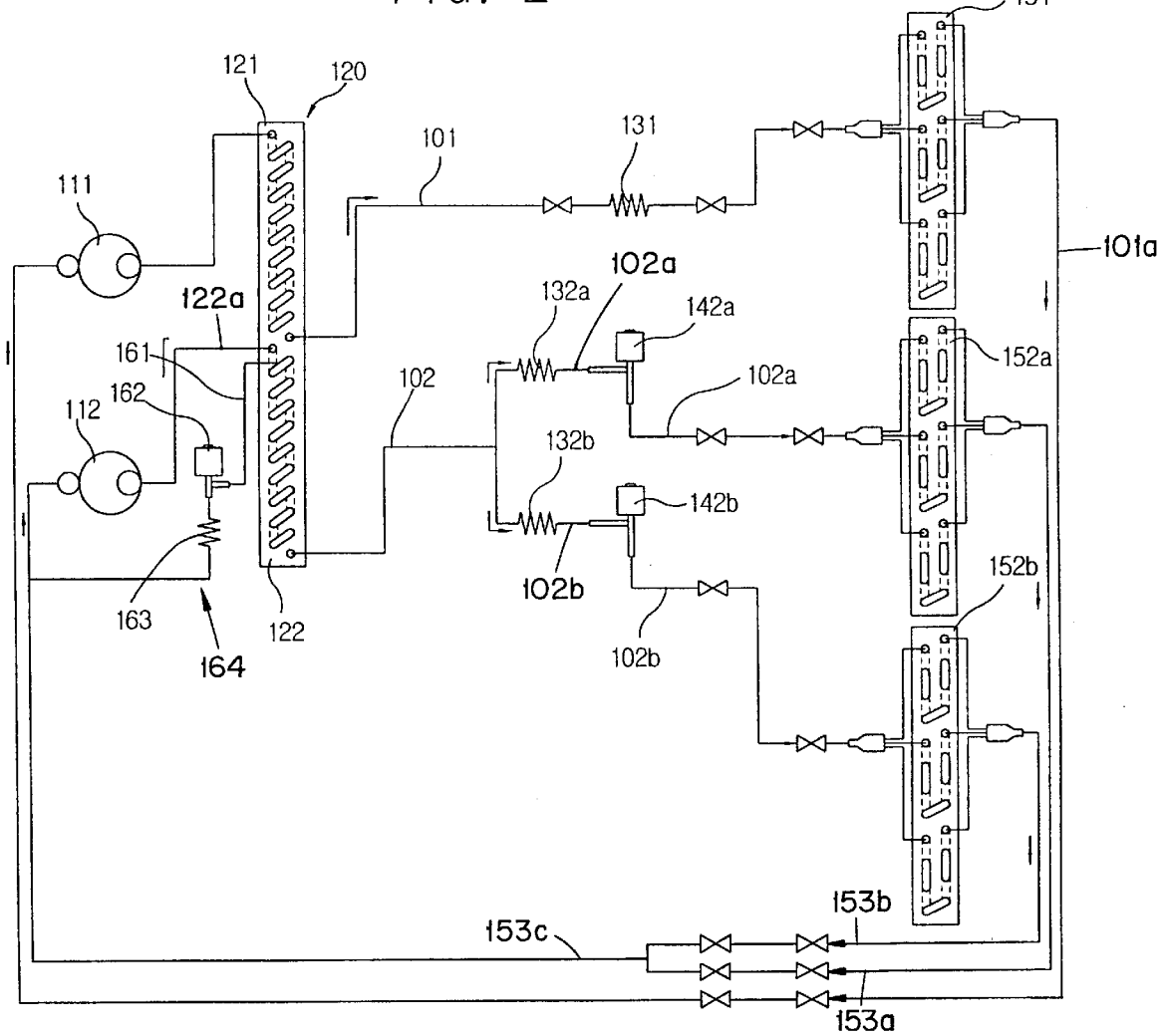
FIG. 2 is a schematic view showing a construction of a multi-unit air conditioner according to a preferred embodiment of the present invention.

A multi-unit air conditioner according to the preferred embodiment of the present invention is shown in FIG. 2.

Referring to FIG. 2, an outdoor heat-exchanger 120 has a pair of circulation paths, i.e., a single-unit circulation path 121 and a multi-unit circulation path 122.

An inlet of the single-unit circulation path 121 is connected with an outlet of a single-unit compressor 111, while an outlet thereof is connected with a single-unit indoor heat-exchanger 151. A capillary tube 131 is installed in a refrigerant pipe 101 connecting the outlet of the single-unit circulation path with the single-unit indoor heat-exchanger 151. Furthermore, the outlet of the single-unit indoor heat-exchanger 151 is connected with the inlet of the single-unit compressor 111.

Meanwhile, an inlet of the multi-unit circulation path 122 is connected with an outlet of the multi-unit compressor 112 via pipe 122*a*. The outlet of the circulation path 122 is connected to a pair of multi-unit indoor heat-exchangers 152*a* and 152*b*. The outlets of those heat-exchangers 152*a*, 152*b* are connected to pipes 153*a* and 153*b*, respectively, and those pipes are connected to the inlet of the multi-unit compressor 112 via pipe 153*c*. More specifically, a by-pass pipe 161 of a by-pass section 164 connects one end portion of the multi-unit circulation path 122 (i.e., a portion close to the path inlet) to the pipe 153*c*, i.e. to the inlet of the multi-unit compressor 111. Additionally, the by-pass section 164 includes a capillary tube 163, and a by-pass valve 162 installed in the by-pass pipe 161.

The refrigerant discharged from the outlet of the multi-unit circulation path 122 flows through a refrigerant pipe 102. The refrigerant pipe 102 has two branches 102*a*, 102*b* which are respectively connected to the multi-unit indoor heat-exchangers 152*a* and 152*b*. Additionally, pressure-reducing capillary tubes 132*a* and 132*b* and opening/closing valves 142*a* and 142*b* are installed in respective ones of the branches 102*a*, 102*b*.

As described above, the multi-unit air conditioner according to the preferred embodiment of the present invention is divided into the single-unit refrigerant cycle and a multi-unit refrigerant cycle operating respectively.

In the single-unit cycle, the refrigerant exhausted from the single-unit compressor 111 is circulated through the single-unit circulation path 121 of the outdoor heat-exchanger 120, the capillary tube 131, the single-unit indoor heat-exchanger 151, and introduced back into the single-unit compressor 111.

In the multi-unit cycle, the multi-unit indoor heat-exchangers 152*a* and 152*b* are selectively operated by means of a pair of opening/closing valves 142*a* and 142*b*.

The operation of the multi-unit cycle will now be described in greater detail.

First, when both of the multi-unit indoor heat-exchangers 152*a* and 152*b* are simultaneously operated, both of the opening/closing valves 142*a* and 142*b* are in an open state, and the by-pass valve 162 is closed.

In this state, refrigerant compressed in the multi-unit compressor passes through the multi-unit circulation path 122 of the outdoor heat-exchanger 120. Since the by-pass valve 162 is in a closed state, the refrigerant is not by-passed to the inlet of the multi-unit compressor 112 through the by-pass pipe 161, but rather is discharged through the outlet of the multi-unit circulation path 122. The refrigerant discharged from the outlet of the multi-unit circulation path 122 flows through the refrigerant pipe 102 until it is divided into the two branches thereof and then the divided refrigerant streams lose pressure in capillary tubes 132*a* and 132*b*. The refrigerant passing the capillary tubes 132*a* and 132*b* is introduced into the two indoor heat-exchangers 152*a* and 152*b* to be heat-exchanged. The refrigerant discharged from indoor heat-exchangers 152*a* and 152*b* is then joined at pipe 153*a* to be introduced into the multi-unit compressor 112.

Second, when only one, e.g. heat-exchanger 152*b*, of the two indoor heat-exchangers 152*a* and 152*b* is operated, the opening/closing valve 142*a* of the refrigerant pipe 102 connected to the inactive indoor heat-exchanger 152*a* is closed, and the by-pass valve 162 is opened.

Accordingly, the refrigerant from the multi-unit compressor 112 is introduced into the multi-unit circulation path 122, and a predetermined amount of that refrigerant is by-passed to the inlet of the multi-unit compressor 112 through the by-pass pipe 161. The refrigerant by-passed via by-pass pipe 161 loses pressure as it passes through the capillary tube 163. The reason capillary tube 163 is installed in the by-pass pipe 161 is to reduce the pressure of the already pressurized refrigerant, so that the refrigerant will not become excessively pressurized as a result of passing again through the compressor 112.

The non-by-passing portion of refrigerant from the circulation path 122 flows into the multi-unit indoor heat-exchanger 152*b* through the refrigerant pipe 102. The refrigerant only flows through the branch pipe 120*b* whose opening/closing valve 142*b* is opened. Therefore, the refrigerant is introduced into the multi-unit indoor heat-exchanger 152*b* connected to the opened opening/closing valve 142*b*.

As described, a predetermined amount of the refrigerant introduced into the multi-unit circulation path of the outdoor heat-exchanger 122 is by-passed to the multi-unit compressor 112 through the by-pass pipe 161, so that the flow rate of refrigerant introduced into the inlet of the compressor is adjusted to a reasonable amount, as well as the flow rate of refrigerant introduced into the multi-unit indoor heat-exchanger which is in use.

According to the present invention as described above, when one of two multi-unit indoor heat-exchangers is in use, a predetermined amount of the refrigerant is by-passed to the multi-unit compressor via the by-pass section and thus is not introduced into the indoor heat-exchanger. Accordingly, the flow rate of the refrigerant introduced into the inlet of the compressor, and flow rate of refrigerant flowing to the indoor heat-exchanger can be always maintained to a reasonable degree. As a result, an excessive amount refrigerant is prevented from being supplied into the indoor heat-exchanger, so the indoor heat-exchanger is prevented from being frozen. Furthermore, the refrigerant is prevented from being introduced into the compressor in a liquid state, so that the reliability of the compressor is improved.

While the present invention has been particularly shown and described with reference to a preferred embodiment thereof, it will be understood by those skilled in the art that various changes in form and details may be effected therein without departing from the spirit and scope of the invention as defined by the appended claims.

What is claimed is:

1. A multi-unit air conditioner, comprising:

a compressor for compressing a refrigerant;

an outdoor heat-exchanger having an inlet connected to an outlet of the compressor;

a plurality of indoor heat-exchangers each having an inlet and an outlet, the outlets of the heat-exchangers connected to an inlet of the compressor;

refrigerant pipes connecting respective ones of the heat-exchanger inlets in parallel to an outlet of the outdoor heat-exchanger;

a plurality of pressure reducing devices disposed in respective ones of the pipes;

a plurality of opening/closing valves mounted to respective ones of the pipes for selectively opening and closing communication between the respective heat-exchanger inlets and the outlet of the outdoor heat-exchanger; and an openable/closable by-pass pipe for returning a portion of the refrigerant back to the inlet of the compressor before that portion of the refrigerant reaches the indoor heat-exchangers, the by-pass pipe being opened when one of the opening/closing valves is closed.

2. The air conditioner according to claim 1, further including a by-pass valve arranged to open and close the by-pass pipe.

3. The air conditioner according to claim 2, wherein the by-pass pipe communicate with the outdoor heat-exchanger at a location between the inlet and outlet thereof.

4. The air conditioner according to claim 3, wherein the by-pass pipe communicates with the outdoor heat-exchanger at a location closer to the inlet thereof than to the outlet thereof.

5. The air conditioner according to claim 3, further including a pressure-reducing device disposed in the by-pass pipe.

6. The air conditioner according to claim 1, further including a pressure-reducing device disposed in the by-pass pipe.

7. A multi-unit air conditioner comprising:

a first and second compressors for compressing a refrigerant;

an outdoor heat-exchanger having first and second separate circulation paths, the first path having an inlet connected to an outlet of the first compressor, and the second path having an inlet connected to an outlet of the second compressor;

a first indoor heat-exchanger having an inlet and an outlet, the outlet connected to an inlet of the first compressor;

a first refrigerant pipe connecting the inlet of the first heat-exchanger to an outlet of the first circulation path;

a first pressure reducing device disposed in the first refrigerant pipe;

a first opening/closing valve mounted to the first refrigerant device for selectively opening and closing communication between the first heat-exchanger and the outlet of the first circulation path;

a plurality of second indoor heat-exchangers each having an inlet and an outlet, the outlets of the second heat-exchangers connected to an inlet of the second compressor;

a plurality of second refrigerant pipes connecting respective inlets of the second heat-exchangers in parallel to an outlet of the second circulation path;

a plurality of second pressure reducing devices disposed in respective ones of the second refrigeration pipes;

a plurality of second opening/closing valves mounted to respective ones of the second refrigeration pipes for selectively opening and closing communication between the respective inlets of the second heat-exchangers and the outlet of the second circulation path; and an openable/closable by-pass pipe for returning a portion of the refrigerant back to the inlet of the second compressor before that portion of the refrigerant reaches the second indoor heat-exchangers, the by-pass pipe being opened when one of the second opening/closing valves is closed.

8. The air conditioner according to claim 7, further including a by-pass valve arranged to open and close the by-pass pipe.

9. The air conditioner according to claim 8, wherein the by-pass pipe communicates with the second circulation path at a location between the inlet and outlet thereof.

10. The air conditioner according to claim 9, wherein the by-pass pipe communicates with the second circulation path at a location closer to the inlet thereof than to the outlet thereof.

11. The air conditioner according to claim 9, further including a pressure-reducing device disposed in the by-pass pipe.

12. The air conditioner according to claim 7, further including a pressure-reducing device disposed in the by-pass pipe.

* * * * *